United States Patent [19]

Moe et al.

[11] 4,279,527

[45] Jul. 21, 1981

[54] LIQUID DISPENSER AND APPLICATOR

[76] Inventors: Walter Moe, 13039 Sky Valley Rd., Los Angeles, Calif. 90049; Charles M. Diker, 944 Fifth Ave., New York, N.Y. 10021

[21] Appl. No.: 92,058

[22] Filed: Nov. 6, 1979

Related U.S. Application Data

[63] Continuation-in-part of Ser. No. 901,293, May 1, 1978, abandoned.

[51] Int. Cl.[3] ..... A46B 11/04

[52] U.S. Cl. ..... 401/277; 401/288; 401/290

[58] Field of Search ..... 401/286, 288, 281, 280, 401/278, 277, 275, 274, 270, 263, 186, 290

[56] References Cited

U.S. PATENT DOCUMENTS

| | | | |
|---|---|---|---|
| 450,662 | 4/1891 | Darrell | 401/183 |
| 519,223 | 5/1894 | Bailey | 401/277 |
| 631,000 | 8/1899 | Symonds | 401/269 X |
| 1,256,142 | 2/1918 | Lamb | 401/277 X |
| 1,359,733 | 11/1920 | Palmer | 401/277 |
| 1,374,294 | 4/1921 | Fischer et al. | 401/277 X |
| 1,538,225 | 5/1925 | Stockseth | 401/277 X |
| 1,577,192 | 3/1926 | Rapisardi | 401/277 |
| 2,522,617 | 9/1950 | Ijams | 401/185 X |
| 2,669,740 | 2/1954 | Main | 401/277 |
| 2,827,650 | 3/1958 | Morrill et al. | 401/280 X |
| 2,832,087 | 4/1958 | McEwan | 401/183 |
| 2,905,956 | 9/1959 | Fuller et al. | 401/183 X |
| 2,909,798 | 10/1959 | Marion | 401/185 |
| 2,945,252 | 7/1960 | Martineau, Jr. | 401/269 X |
| 3,206,789 | 9/1965 | Krauth | 401/183 |
| 4,066,367 | 1/1978 | Sherosky | 401/270 X |
| 4,199,270 | 4/1980 | Tomasini | 401/277 X |

FOREIGN PATENT DOCUMENTS

| | | | |
|---|---|---|---|
| 61581 | 11/1954 | France | 401/277 |
| 483623 | 8/1953 | Italy | 401/277 |

*Primary Examiner*—Steven A. Bratlie
*Attorney, Agent, or Firm*—Reagin & King

[57] ABSTRACT

A liquid dispenser and applicator for use with a squeeze-type container having a neck portion with a neck member affixed thereto, the neck member having an opening for passage of fluid and a generally outwardly axially extending needle-shaped portion. A generally hollow frusto-conical cap member threadably engages the neck member, the cap portion having an aperture at the apex thereof for receiving the needle-shaped portion therethrough with the cap member fully threaded to thereby seal the container. A brush member is affixed to the apex end of the cap member, the brush member having an aperture in alignment with the aperture of the cap for dispensing liquid therethrough into contact with the bristles of the brush.

1 Claim, 5 Drawing Figures

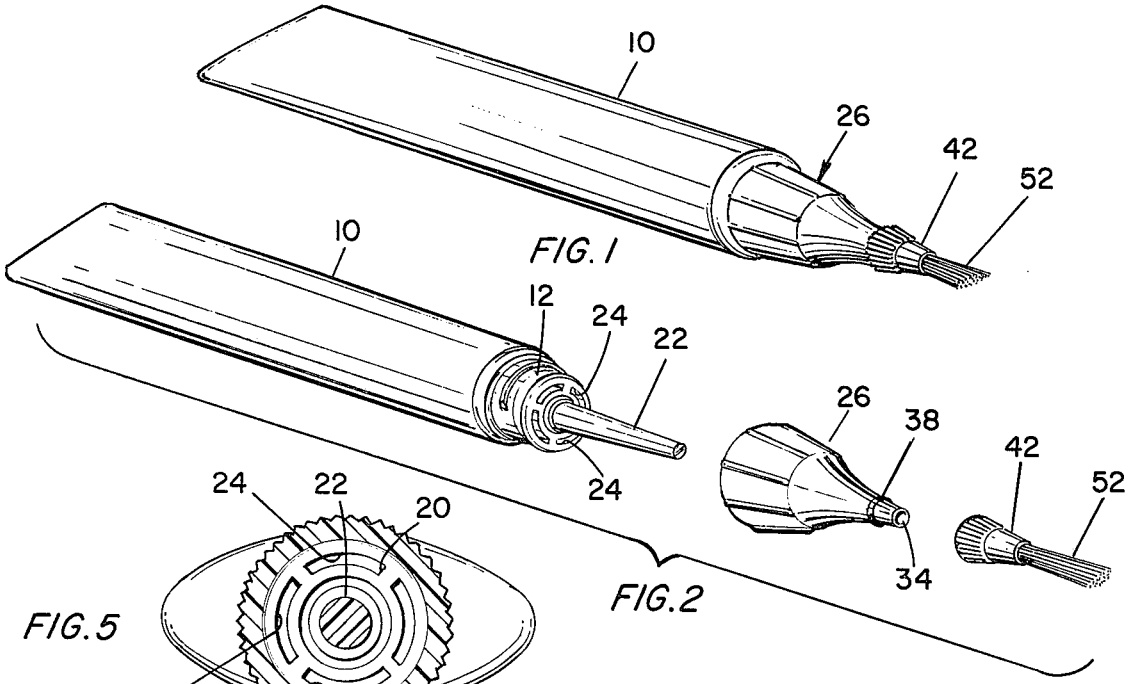
FIG. 1
FIG. 2
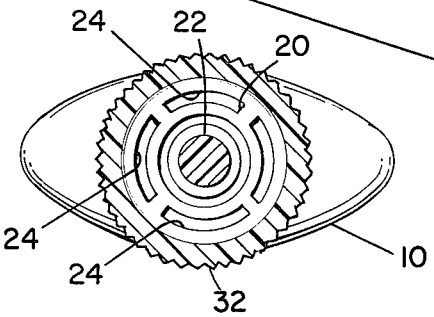
FIG. 5
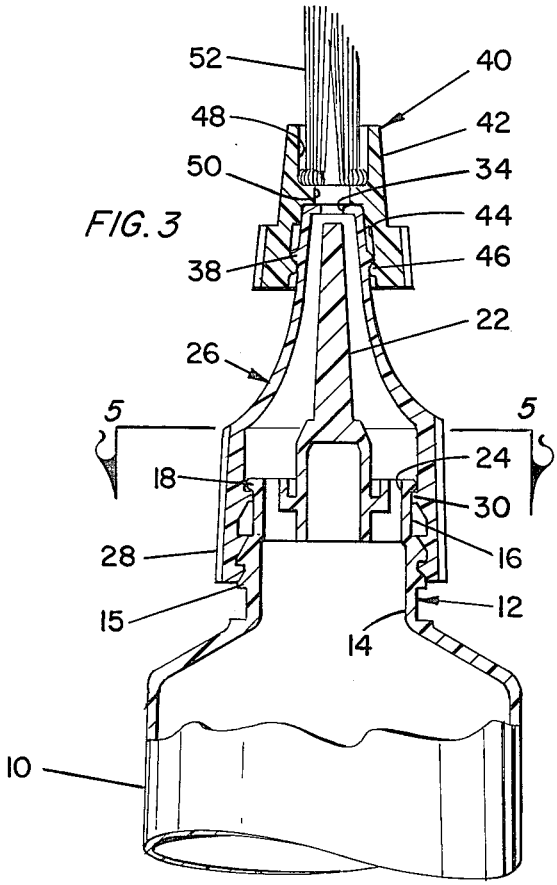
FIG. 3
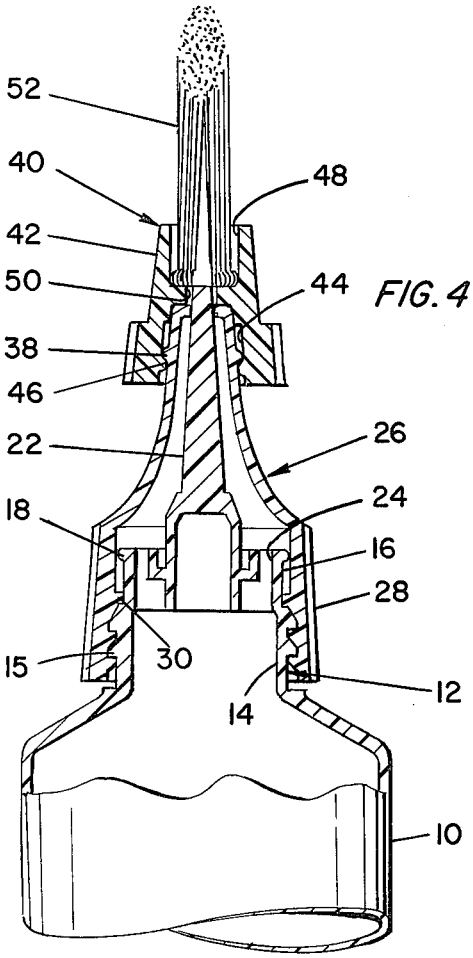
FIG. 4

LIQUID DISPENSER AND APPLICATOR

This is a continuation-in-part of U.S. Pat. application Ser. No. 901,293, filed May 1, 1978 now abandoned.

BACKGROUND OF THE INVENTION

The background of the invention will be discussed in two parts:

This invention relates to liquid dispensers, and more particularly to a liquid dispenser having an applicator for use with a squeeze-type container.

2. Description of the Prior Art

Squeeze-type containers for dispensing liquid have found a variety of uses, and have been used to dispense shoe polish, glue, paints, inks, liquid detergents and the like.

One such liquid dispenser shown in U.S. Pat. No. 3,206,789 to Krauth issued Sept. 21, 1965. The liquid dispenser of this patent provides a flow bore with a filter pad through which the liquid passes into contact with a capillary section terminating at a point spaced from a brush head. Another liquid container and applicator is shown in U.S. Pat. No. 2,945,252 issued July 19, 1960, to Martineau, Jr. Other applicator type dispensers are likewise shown in U.S. Pat. Nos. 631,000; 450,662; 2,522,617; 2,832,087; 2,905,956; and 2,909,798. All of such devices are adapted for dispensing liquid to or through an applicator for use by the consumer.

It is an object of the present invention to provide a new and improved liquid dispenser and applicator.

It is another object of this invention to provide a new and improved brush tip applicator for use with a squeeze-type container.

It is a further object of this invention to provide a new and improved liquid dispenser and brush tip applicator for use with paints, inks, or the like.

SUMMARY OF THE INVENTION

The foregoing and other objects of the invention are accomplished by providing a squeeze-type container having a threaded neck portion encircling the opening thereof with the neck member having openings for passage of the liquid therethrough and an outwardly extending axially disposed generally needle-shaped portion. A generally hollow frusto-conical cap member threadably engages the neck member with the neck member having an annular shoulder adjacent the extremity thereof and the cap member having the inner periphery thereof configured for captive retention by the neck member while permitting axial displacement within the limits defined by the thread. The apex of the cap member is provided with an aperture normally engaged in sealing relation by the tip of the needle-shaped portion while permitting flow of fluid through the aperture when the cap member is rotated to axially displace the same away from the tube. The apex end of the cap member is provided with an annular shoulder portion in proximate relation to the tip thereof for frictionally engaging an inwardly extending peripheral rib formed in the opening of a brush member which includes a generally rigid adapter portion in the form of a cap having an aperture extending therethrough in general alignment with the aperture of the cap member, and having generally axially extending bristles secured thereto for receiving fluid passing through the aperture of the brush member. The brush member may have differing brush forms and bristle sizes for different purposes.

Other objects, features and advantages of the invention will become apparent from a reading of the specification when taken in conjunction with the drawings in which like reference numerals refer to like elements in the several veiws.

BRIEF DESCRIPTION OF THE DRAWINGS

FIG. 1 is a perspective view of a squeeze-type container having the liquid dispenser and applicator according to the invention;

FIG. 2 is an exploded perspective view of the device of FIG. 1;

FIG. 3 is a front sectional view of the device of FIG. 1 illustrating the dispenser in the flow position;

FIG. 4 is a front sectional view illustrating the dispenser according to the invention in a closed position, and further illustrating a modified form of brush; and FIG. 5 is a cross sectional view taken generally along line 5—5 of FIG. 3.

DESCRIPTION OF THE PREFERRED EMBODIMENT

Referring now to the drawings and particularly to FIGS. 1 and 2 there is shown the apparatus according to the invention which includes a squeeze-type tube generally designated 10 having a reduced diameter neck portion 12 with an opening 14 extending therethrough. The tube 10 may be made of any deformable material such as plastic or the like and may conveniently contain a fluid or liquid such as paint, ink or the like. The neck portion 12 is generally tubular with a threaded portion 15 nearest the container, a reduced diameter portion 16 extending outwardly therefrom and terminating in an annular shoulder 18 adjacent the end thereof.

Within the opening 14, a plurality of inwardly extending radial ribs 20 (see FIG. 5) are formed integrally with the neck member 12 for supporting an axially outwardly extending needle-shaped portion 22 which is likewise integrally formed with the neck member 12. Intermediate the ribs 20 are four arcuately segmented openings 24 which permit the passage of fluid from within the container or tube 10 through the opening 14 and thence through the arcuate segmented openings 24.

A cap member, generally designated 26 has an enlarged end 28 with the inner periphery thereof threaded for matingly engaging the threaded end 15 of the neck member 12. The inner periphery of the enlarged end 28 is provided with a reduced diameter inwardly extending peripheral rib 30 which, with the cap member 26 engaging the neck member 12 as shown in FIGS. 3 and 4, abuts against the reduced diameter portion 16 for captively retaining the cap member 26 on the neck member 12. The length of the reduced diameter portion 16 is generally coextensive with the amount of axial displacement required of cap member 26 relative to neck member 12 for operation of the liquid dispenser and applicator as will hereinafter be described. The enlarged end 28 of cap member 26 may be conveniently provided with axially extending ribs or knurls 32 about the outer periphery thereof for convenient gripping for rotating the cap member relative to the neck member for relative axial displacement (see FIG. 5).

The cap member 26 is a generally hollow frusto-conical form with the end portion or apex portion thereof having an aperture 34 extending therethrough in general alignment with the tip of the needle-shaped portion 22. The portion 22 is tapered from a larger diameter adjacent opening 14 to a smaller diameter adjacent the end thereof with the diameter of the tip being generally equal to the diameter of aperture 34 of cap member 26.

The exterior of the apex portion of cap member 26 adjacent aperture 34 is provided with a peripheral annular shoulder 38 in proximate relation to the tip of cap member 26. A brush member generally designated 40 is provided, the brush member 40 having an adapter cap member 42 with axially aligned back to back cup-shaped openings 44 and 48 having a common bottom, the opening 44 being configured for engaging the tip or apex portion of the cap member 26. The opening 44 is provided with an inwardly extending peripheral rib 46 for frictionally engaging the shoulder 38 to retain the adapter member 42 on the tip of cap member 26. The other cup-shaped opening 48 has an aperture 50 extending through the bottom thereof in general alignment with the aperture 34 of the apex portion of cap member 26. Suitably secured within the interior of cup-shaped opening 48 of the adapter member 42 are bristles which form a brush 52 extending axially outwardly from within the cup-shaped opening 48, the bristles generally surrounding the aperture 50 to provide a flow path for the fluid or liquid being discharged. The bristles which form brush 52 may be secured within the opening 48 by means of adhesive or by use of an additional ferrule or insert or the like with the bristle size and shape being selected to provide a brush 52 having the desired characteristic. For example, the brush may be configured as a detail brush or a large area brush or the like. In any event, fluid or liquid passing from the tube 10 will pass through the neck opening 14, thence through the arcuate openings 24 into the interior discharge chamber formed between the inner surface of cap member 26 and the outer surface of the needle-shaped portion 22 of the neck member 12 for selective discharge through the aperture 34, thence through the aperture 50 of adapter member 42 into the central interior of the brush 52 for application as desired by the user.

As illustrated in FIG. 4, with the cap member 26 fully threaded onto the neck member 12, the tip of the needle-shaped portion 22 of the neck member 12 extends into and slightly through the aperture 34 of the apex portion of cap member 26 thereby preventing the discharge of the contents of tube 10, this position corresponding to the closed or off position of the dispenser. In this position, the peripheral rib 30 on the interior of the enlarged end 28 of cap member 26 bears against the end of the threaded portion 15 of neck member 12. By rotating the enlarged end 28 of cap member 26 to open the cap member 26, the peripheral rib 30 slides along the reduced diameter portion 16 until the cap member is displaced axially relative to neck member 12 the distance defined by the reduced diameter portion 16, in which position, as shown in FIG. 3, the peripheral rib 30 is abuttingly engaging the annular shoulder 18 to thereby effect captive retention of cap member 26. In the "flow" position the aperture 34 of cap member 26 is displaced axially relative to the tip of the tapered needle-shaped portion 22 thereby permitting fluid or liquid to be discharged through the opening 34, thence through the opening 50 of adapter member 42 of brush member 40 into the interior of the bristles forming the brush 52 for suitable discharge and application as desired. The extension of the needle-shaped portion 22 into opening 50 is especially useful in providing a clear path for highly viscous fluids such as paints.

Although the neck member 12 has been shown to be integral with the tube 10, the neck member 12 may be a separate piece suitably affixed to the neck end of a squeeze type container or tube. Similarly, although fluid is discharged through the opening 14 through the arcuate segmented openings 24, it is also to be understood that the discharge may be effected by providing a hollow needle-shaped portion with angularly offset orifices about the periphery thereof. However, by the use of the arcuate segmented openings 24, clogging within the cap member 26 becomes less of a problem. While there has been shown and described a preferred embodiment it is to be understood that various other adaptations and modifications may be made within the spirit and scope of the invention.

What is claimed is:

1. In a liquid dispenser and applicator for use with highly viscous fluids, the combination comprising:

a squeeze-type container formed with a single opening;

a neck member permanently affixed to the container at said single opening to the interior of the container, said neck member having a generally needle-shaped portion extending axially outwardly relative to said single opening, said neck member also including a plurality of arcuate segmented apertures to permit the rapid filling and dispensing of the fluid from the container;

a generally hollow cap member threadably coupled at one end thereof to said neck member, the other end of said cap member having an opening aligned for passage therethrough of said needle-shaped portion and for closure thereagainst in a manner such that said needle-shaped portion projects beyond the exterior of said cap member with said cap member fully threaded on said neck member, said cap member having a reduced diameter tip adjacent to the opening thereof;

brush means detachably coupled to said reduced diameter tip of said cap member, said brush means having an aperture in general alignment with the opening in said reduced diameter tip for receiving the projecting end of said needle-shaped portion with said cap member fully threaded on said neck member and for enabling the fluid to flow to the interior of said brush means with said cap member partially unthreaded for applying the fluid to a surface, said brush means including an adapter member having first and second generally cup-shaped openings with a common bottom, said first cup-shaped opening having a rib portion for engaging a rib portion on said reduced diameter tip of said cap member, and said second cup-shaped opening having the brush bristles secured therein.

* * * * *